United States Patent [19]

Elmalek et al.

[11] Patent Number: 5,052,063

[45] Date of Patent: Oct. 1, 1991

[54] FIXING SYSTEM WITH VARIABLE SUSPENSION AND ARTICULATION, PARTICULARLY FOR BEDS OR SEATS

[75] Inventors: Pierre Elmalek, Paris; Guy Nathan, Yerres, both of France

[73] Assignee: Vieux Chene Expansion Sarl, Montmagny, France

[21] Appl. No.: 552,803

[22] Filed: Jul. 16, 1990

[30] Foreign Application Priority Data

Jul. 26, 1989 [FR] France ..... 89 10037

[51] Int. Cl.[5] ..... A47C 23/05

[52] U.S. Cl. ..... 5/238; 5/241

[58] Field of Search ..... 5/191, 236.1, 237, 238, 5/239, 241

[56] References Cited

U.S. PATENT DOCUMENTS 3,176,323 4/1965 Degen ..... 5/238
4,136,411 1/1979 Fanti ..... 5/191

FOREIGN PATENT DOCUMENTS 3212346 10/1983 Fed. Rep. of Germany ..... 5/241
3510971 10/1986 Fed. Rep. of Germany ..... 5/191
3738126 5/1989 Fed. Rep. of Germany ..... 5/238

*Primary Examiner*—Michael F. Trettel
*Attorney, Agent, or Firm*—Nixon & Vanderhye

[57] ABSTRACT

The present invention discloses a variable and articulated suspension fixing system, particularly for beds or seats, comprising a suspension and articulation piece (2), a first means (4A, 4B) for securing the suspension piece (2) to the frame (1) of the mattress or seat, a second means (51, 52) for securing the slat (3) to the suspension piece (2), said suspension piece (2) comprising two symmetrical resilient structures (20, 21) in the form of cylindrical tubes parallel to the slat and spaced apart by a distance corresponding to the dimension of the slat portion (30) bearing on this suspension piece (2), the two resilient structures (20, 21) being joined together by a connecting strut (22), characterized in that the connecting strut is connected to the two cylindrical tubes so that the connecting surface is situated inside the volume defined by the vertical planes passing through the axes of symmetry of each cylinder.

18 Claims, 4 Drawing Sheets

FIXING SYSTEM WITH VARIABLE SUSPENSION AND ARTICULATION, PARTICULARLY FOR BEDS OR SEATS

The present invention relates to a variable suspension and articulated fixing system, particularly for beds or seats.

BACKGROUND OF THE INVENTION

Articulated suspension systems are known, for example from the Swiss patent 656 787 for slatted mattresses.

This type of device, shown in FIG. 5, comprises resilient means 522, 523 forming a vertical suspension and a pivoting shaft 25, 524 providing an articulation permitting rotation of the slat about a shaft 25 parallel to its longitudinal axis and fixed by a piece 18 to the frame of the bed. At the same time, the device provides connection of the slat with the suspension by means of a sleeve 19. Flanges 28, 29 integral with the pivoting shaft 25 provide resistance to rotation of the suspension piece.

To secure the slat to the suspension piece, it is necessary to have a certain rigidity which is not compatible with the resilience required for the suspension function.

Because of the multiplicity of functions performed by this single piece, the construction is complex resulting in a high production cost. Similarly, the multiplicity of functions requires a compromise between the choice of the resilient qualities of the material. This compromise is prejudicial, either to the resilience function or to the connection function.

SUMMARY OF THE INVENTION

A first aim of the invention is to provide a fixing system with variable articulated suspension whose suspension and articulation function is provided by a single piece which is inexpensive to produce.

This first aim is attained by the fact that the variable and articulated suspension fixing system for the slat of a mattress or seat comprises a suspension and articulation piece, a first means for securing the suspension piece to the frame of the mattress or seat, a second means for securing the slat to the suspension piece, said suspension piece comprising two symmetrical resilient structures in the form of cylindrical tubes parallel to the slat and spaced apart by a distance corresponding to the dimension of the slat portion bearing on this suspension piece, the two resilient structures being joined together by a connecting strut forming the contact surface with the slat.

According to a complementary characteristic, the cylindrical tube has a circular section.

According to another characteristic, the cylindrical tube has an elliptic section.

According to another characteristic, the cylindrical tube has a parallelepiped section.

According to another characteristic, the cylindrical tube has a hexagonal section.

Another aim is to provide a piece which avoids translation of the shaft of the slat parallel to the longitudinal direction of the frame.

This aim is attained by the fact that the connecting strut is connected to the two cylindrical tubes so that the connecting surface is situated inside the volume defined by the vertical planes passing through the axes of symmetry of each cylinder.

Another aim of the invention is to provide a fixing system with variable elasticity.

This aim is attained by the fact that a wedge is placed between the two cylindrical tubes.

The wedge has lateral surfaces corresponding in a first variant to cylinder quarters identical to those of the periphery of the cylindrical suspension tubes and spaced apart so that the axis of symmetry of each quarter of a circle merges with the axis of symmetry of the two tubes.

In a second variant the wedge has lateral surfaces forming quarters of an ellipse and spaced apart so that the axis of symmetry of the ellipse coincides with the axes of symmetry of the two structures.

According to another characteristic, the structure has on the diameter opposite the point of contact of the strut with each cylindrical structure a tongue clamped to the frame by a first securing means formed by a rigid U shaped piece.

According to another characteristic, the first securing means is a bar in the form of a U placed inside each cylinder and fixed by appropriate means to the upright of the frame.

According to another characteristic, the second securing means is a flat headed rivet on the shank of which a locking washer is fitted.

BRIEF DESCRIPTION OF THE DRAWINGS

Other features and advantages of the present invention will be clear from the following description with reference to the accompanying drawings in which.

DESCRIPTION OF THE PREFERRED EMBODIMENT

Figure 1:
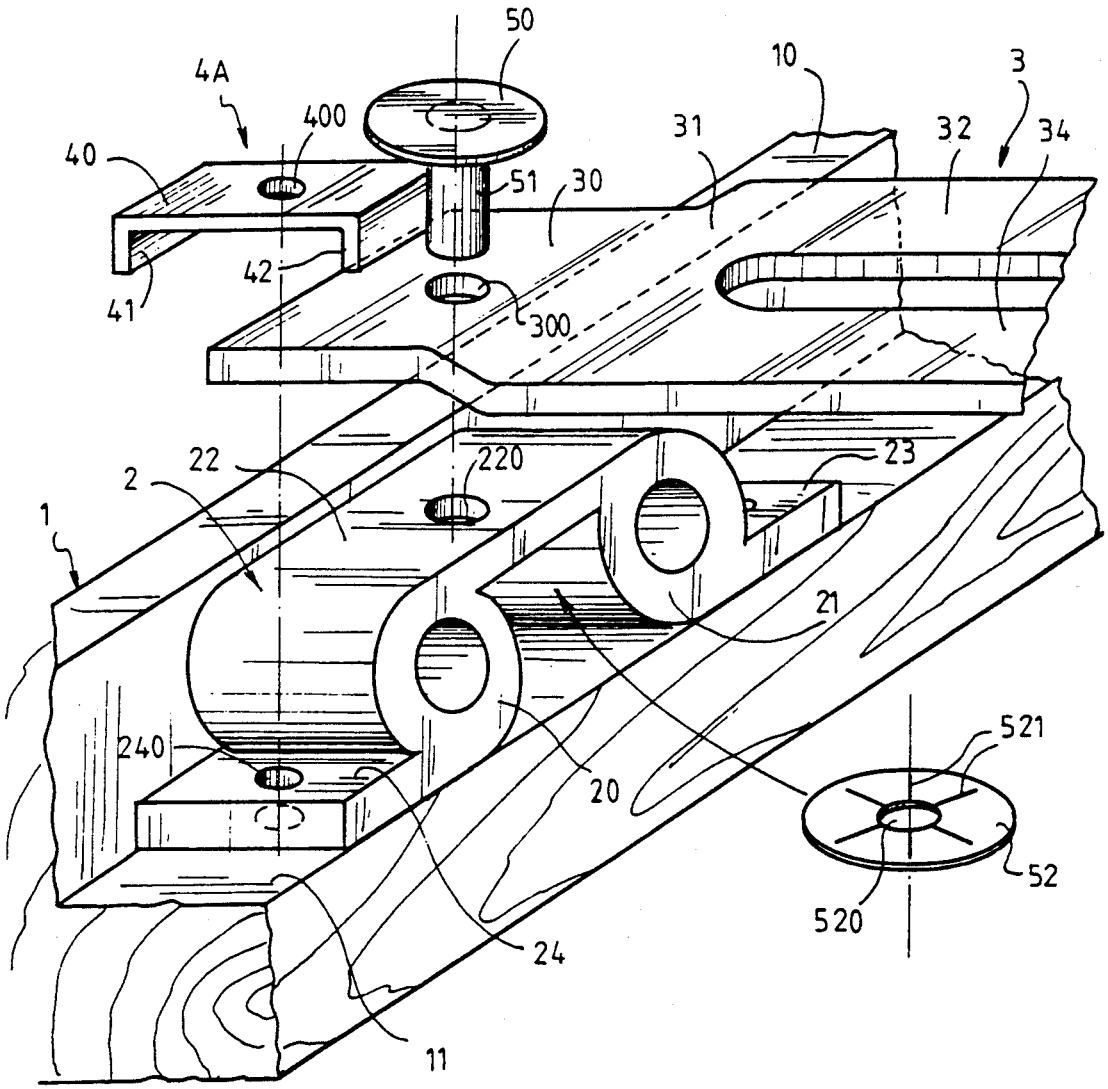
FIG. 1 shows an exploded perspective view of the fixing system of the invention.

The fixing system of the invention is mounted on a bed-frame 1 formed for example by right-angled uprights, i.e. with L shaped section 10, 11. The device may also be readily adapted to a bed-frame whose upright is simply formed by the longitudinal parallelepipedic upright 11 without the vertical portion 10 of the L.

The suspension device for a slatted mattress or seat is formed by a single suspension piece 2 at each slat end. The suspension piece 2 is made from a resilient material such as rubber or a thermoplastic rubber of a hardness between 60 and 65 Shore A for a thickness of 4 mm. This single piece 2 is formed substantially of two hollow tubes 20, 21 in the form of cylinders whose axes of symmetry are spaced apart by a distance corresponding to the dimension of the portion 30 of the slat 3 which rests on the single piece 2. The cylindrical tubes 20, 21 have their axes of symmetry oriented parallel to the axis of symmetry of the slat 3, i.e. perpendicularly to the longitudinal direction of frame 1. These two cylinders are joined together at the upper part, i.e. at the portion in contact with the end 30 of the slat by a strut 22 whose contact surface with the cylinders 20, 21 is disposed inside the volume defined by the two vertical planes passing through the axes of symmetry of the cylinders 20, 21.

Figure 2:
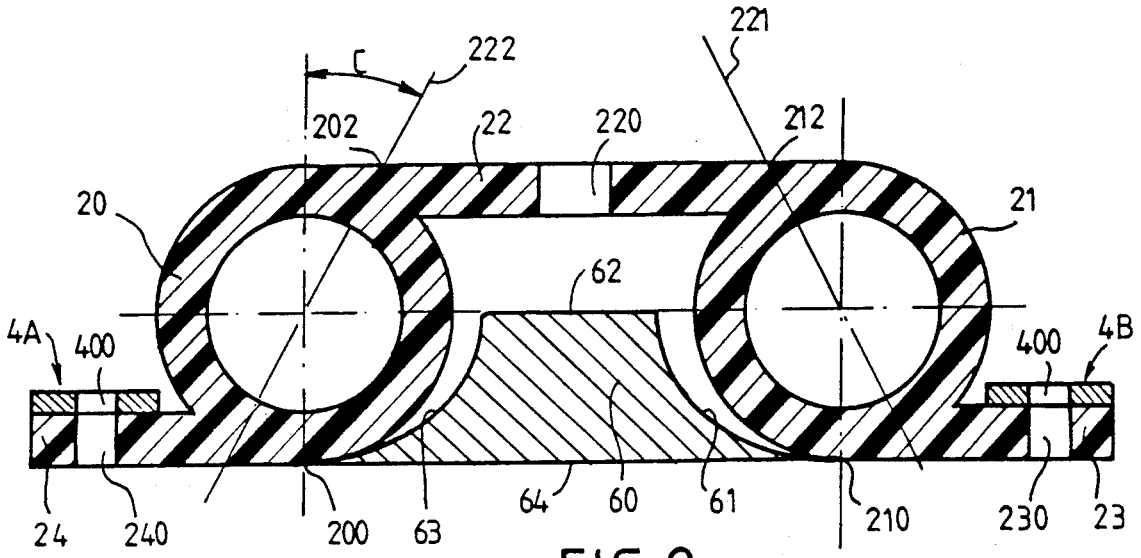
FIG. 2 shows a sectional view of the suspension piece and of the wedge.

As shown in FIG. 2, the point of contact 202 of strut 22 with the left-hand tube 20, and the point of contact 212 of strut 22 with the right-hand tube 21 define the apices of a trapezium with the respective points of contact of the left-hand 20 and right-hand 21 tubes with the bearing surface of the horizontal longitudinal frame member.

The perpendicular to the plane of contact of strut 22 with cylinder 20 is shown in FIG. 2 by the reference 222 and forms an angle C with the vertical plane passing through the axis of symmetry. This strut 22 comprises a hole 220 situated in line with a hole 300 formed in the end 30 of the slat. The diameters of holes 220 and 300 being adapted to allow a rod 51 to pass forming the shank of a flat headed rivet 50. This flat headed rivet 50 is associated with a washer or rectangular locking piece 52 made from spring metal whose internal orifice 520 has a diameter slightly less than the diameter of rod 51. This piece or washer 52 has cut-outs 521 at its internal periphery forming resilient tongues oriented towards the center of the circumference 520. When the slat 3 is laid on the strut 22, rivet 50 is introduced into orifices 300, 220, the washer 52 is force fitted on the rod 51 and secures the slat to the suspension piece 2. The slat suspension piece assembly is secured to the frame and in particular to the horizontal longitudinal member 11 of the frame by a pair of stirrups 4A, 4B situated on each side of the cylindrical tubes 20, 21 of the fixing piece. Each stirrup is formed by a flat surface 40 and two vertical legs 41, 42 so as to form a U whose legs are turned downwards. The horizontal surface 40 comprises a bore 400 whose axis of symmetry coincides with a bore 240 or 230 formed in the tongues 24, 23 which extend the left-hand 20, respectively right-hand 21 cylindrical tubes outwardly. These tongues 24, 23 are tangential to the external generatrix of the cylinders and the contact surface of these tongues 24, 23 with the respective cylinders is situated in the opposite direction on the shafts 222, 221 corresponding to the perpendicular surfaces of contact of strut 22 with the cylinders 20, 21, as shown in FIG. 2. The shafts 222, 221 perpendicular to the contact surfaces of the strut form a sufficient angle to prevent the strut from rolling outwards, consisting in point 212 or 202 going beyond the vertical of the contact points 200, 210. With this arrangement, deformation towards the inner space of the tubes is promoted rather than to the outer space. Advantageously, slats 3 may be formed by ends 30 of reduced width, connected by a widened portion 31 to a central portion formed by two parallel strips 32, 34 separated by a given space. These slats thus formed allow a greater flexibility of the strips 32, 34 to be obtained while providing good maintenance of the mattress, a portion of which penetrates into the gap separating the strips 32, 34 and thus prevent it from sliding. In addition, distribution of the supporting strips 32, 34 along the mattress is better and promotes the passage of air so as to avoid the formation of mold.

FIG. 2 shows a sectional view of the suspension element and of the securing pieces 4A, 4B disposed on each side above tongues 24, 23. These securing pieces 4A, 4B are fixed, for example by screws (see FIG. 1), to the longitudinal upright 11 of the frame and are of a dimension such that they cause crushing of the fixing tongues 24, 23 so that the latter are held by clamping against the frame. Obviously, a single connecting device has been shown on one side of a slat but each slat comprises an identical device at its opposite end and there as many pairs of devices as there are slat on the mattress. For adjusting or modifying the resilience of the device, wedges are incorporated between the two cylinders.

Figure 3:
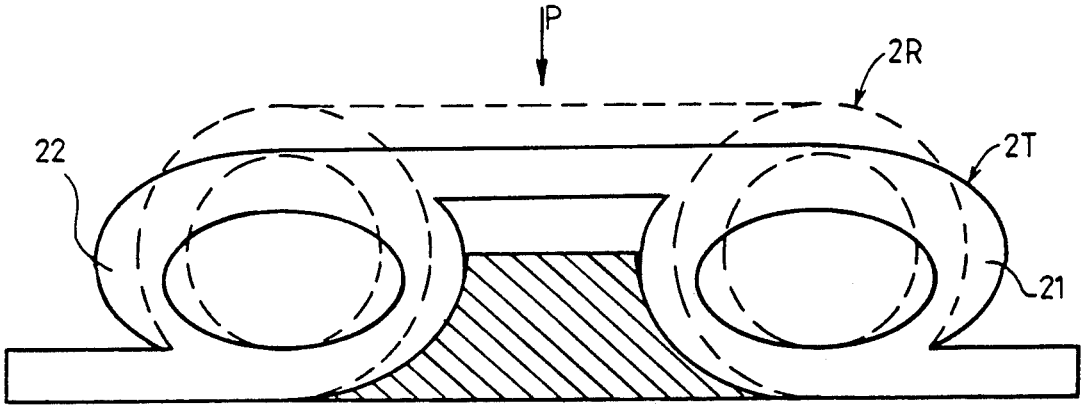
FIG. 3 shows a side view of the suspension piece during stressing.
Figure 4:
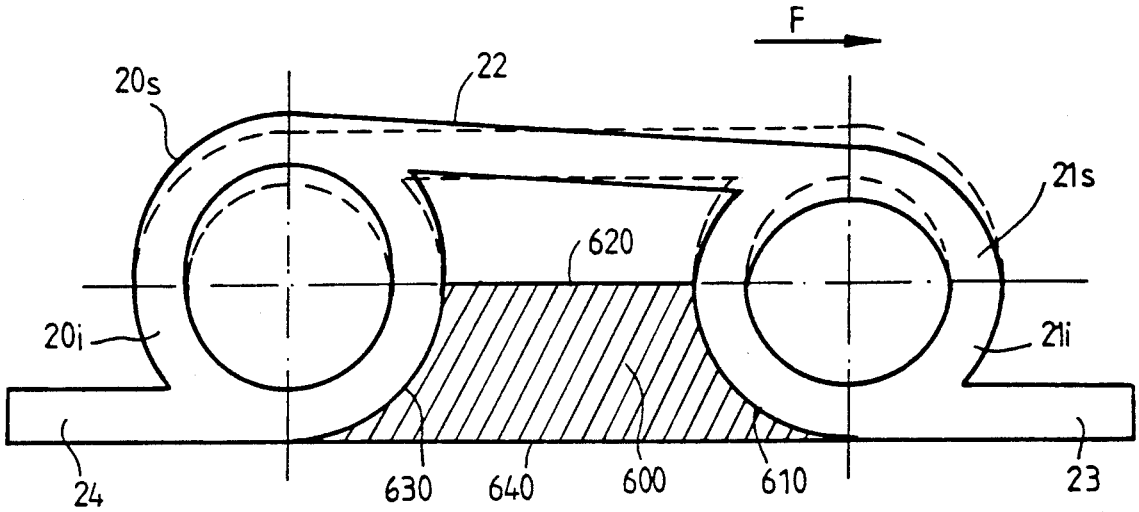
FIG. 4 shows a side view of the suspension piece and of the wedge in the case of pivoting.
Figure 5:
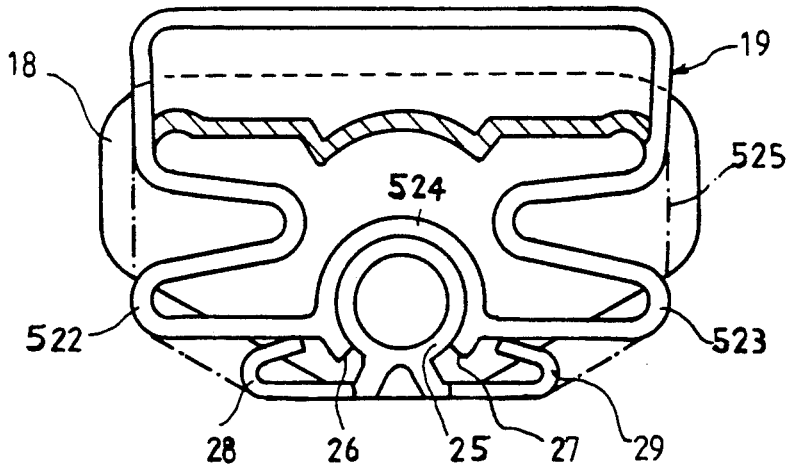
FIG. 5 PRIOR ART
FIG. 5 shows a device of the prior art.
Figure 6A:
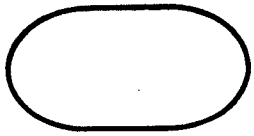
FIGS. 6*a*, 6*b* and 6*c* generally show additional cylindrical forms for the suspension tubes which may be elliptical, parallelepiped or hexagonal in section.
Figure 6B:
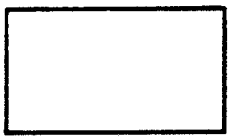
Figure 6C:
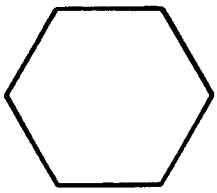
Figure 7:
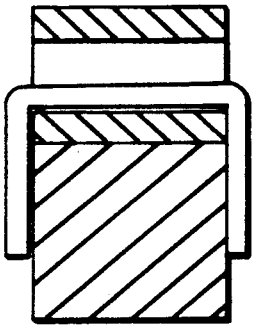
FIG. 7 is generally illustrative of a U-shaped first securing means placed inside a suspension tube cylinder positioned so as to be fixed on a frame.

FIGS. 2 and 3 show a wedge 60 whose lateral surfaces 63, 61 are formed by quarters of a cylinder with elliptic section. This wedge 60 is defined at its lower part and at its upper part by two flat surfaces 64 and 62. FIG. 3 shows the same suspension system when it is subjected to a pressure or force P centered on the axis of symmetry of the suspension system. The cylinders 20, 21 are therefore compressed and are deformed substantially in the form of an ellipse. The cylinders 20, 21 take the form shown with continuous lines under the reference 2T in the working position. The dotted lines referenced 2R show the rest position of the same piece. It will be understood that the wedge 60 disposed between the two cylinders 20, 21 limits the crushing thereof and so it correspondingly increases the rigidity of the suspension from a certain deformation or a certain displacement. A second type of wedge may, as shown in FIG. 4, be also formed by surfaces 610, 630 having the shape of a quarter of a cylinder with circular section. In this case, the surface 620 has a dimension corresponding to the gap separating the external surfaces of the two tubes 20, 21. This latter wedge permits a very limited displacement formed solely by the deformation of the upper half cylinders 205, 215 of the suspension system.

Finally, the third possibility is not to place wedges, which gives greater resilience and allows large displacements.

FIG. 4 also shows the possibilities of rocking or pivoting the suspension without translation about an axis parallel to the axis of symmetry of the slat in the case of wedges corresponding to the second type. In fact, when a force is applied essentially vertically to one of the cylinders 21, the latter is crushed whereas the other 20 is deformed much less while extending, which allows the assembly to pivot. Deformation of the right-hand tube 21 occurs solely on the upper portion **21*s* whereas the lower portion 21*i* held by the surface 610** of the wedge cannot be deformed.

The left-hand tube 20 may be deformed by extending vertically. Thus, strut 22 and slat 3 pivot about the longitudinal axis of symmetry without effecting a longitudinal movement in the direction of arrow F.

It will be understood that thus, using parts of simple construction and readily moldable, a suspension is obtained with adjustable rigidity also allowing articulation about the axis of symmetry of the slat and preventing the longitudinal movements perpendicular to the axis of the slat. The length of tubes 20, 21 further ensure good transverse stability of the slat.

Similarly, the fact that the contact surface of this strut with the cylinders is inside the volume defined by the vertical planes passing through the axes of symmetry of each cylinder avoids longitudinal translational movements of the axis of symmetry of the slat.

Any modification within the scope of a man skilled in the art also forms part of the spirit of the invention.

What is claimed is:

1. Variable and articulated suspension fixing system, particularly for beds or seats having slats, comprising a suspension and articulation piece (2), a first means (4A, 4B) for securing the suspension piece (2) to the frame (1) of the mattress or seat, a second means (51, 52) for securing a slat (3) to the suspension piece (2), said suspension piece (2) comprising two symmetrical resilient structures (20, 21) in the form of cylindrical tubes parallel to said slat and spaced apart by a distance corresponding to the dimension of a portion (30) of said slat bearing on a surface of said suspension piece (2), the two resilient structures (20, 21) being joined together by a single connecting strut (22), characterized in that the connecting strut is connected to the two cylindrical tubes by connecting surfaces that are situated inside the volume defined by vertical planes passing through the axes of symmetry of each cylinder, said connecting strut further characterized as providing the bearing surface for said slat portion.

2. Fixing system according to claim 1, characterized in that each cylindrical tube has a circular section.

3. Fixing system according to claim 1, characterized in that each cylindrical tube has an elliptic section.

4. Fixing system according to claim 1, characterized in that each cylindrical tube has a parallelepiped section.

5. Fixing system according to claim 1, characterized in that the second securing means is a rivet (50, 51) with a flat head (50) on the shank (51) of which a locking washer (52) is fitted.

6. Fixing system according to claim 1 wherein a slat is formed by ends (30) of reduced width connected by a widened portion (31) to a central portion formed by two parallel strips (32, 34) separated by a given space.

7. Variable and articulated suspension fixing system, particularly for beds or seats having slats, comprising a suspension and articulation piece (2), a first means (4A, 4B) for securing the suspension piece (2) to the frame (1) of the mattress or seat, a second means (51, 52) for securing a slat (3) to the suspension piece (2), said suspension piece (2) comprising two symmetrical resilient structures (20, 21) in the form of cylindrical tubes parallel to said slat and spaced apart by a distance corresponding to the dimension of a portion (30) of said slat bearing on a surface of said suspension piece (2), the two resilient structures (20, 21) being joined together by a single connecting strut (22), characterized in that the connecting strut is connected to the two cylindrical tubes by connecting surfaces that are situated inside the volume defined by vertical planes passing through the axes of symmetry of each cylinder, said connecting strut further characterized as providing the bearing surface for said slat portion wherein each cylindrical tube has a hexagonal section.

8. Variable and articulated suspension fixing system, particularly for beds or seats having slats, comprising a suspension and articulation piece (2), a first means (4A, 4B) for securing the suspension piece (2) to the frame (1) of the mattress or seat, a second means (51, 52) for securing a slat (3) to the suspension piece (2), said suspension piece (2) comprising two symmetrical resilient structures (20, 21) in the form of cylindrical tubes parallel to said slat and spaced apart by a distance corresponding to the dimension of a portion (30) of said slat bearing on a surface of said suspension piece (2), the two resilient structures (20, 21) being joined together by a single connecting strut (22), characterized in that the connecting strut is connected to the two cylindrical tubes by connecting surfaces that are situated inside the volume defined by vertical planes passing through the axes of symmetry of each cylinder, said connecting strut further characterized as providing the bearing surface for said slat portion wherein each cylindrical tube has a circular section and further characterized in that a wedge (60) is placed between the two cylindrical tubes (20, 21), said wedge (60) having lateral surfaces (61, 63) corresponding to quarter circles identical to those of the periphery of the cylindrical suspension tubes and spaced apart so that the axis of symmetry of each said quarter circle merges with the axis of symmetry of the two structures (20, 21).

9. Fixing system according to claim 8, characterized in that the structure comprises on the diameter opposite the point of contact of the strut (22) with each structure (20, 21) a torque (23,24) clamped to the frame by a first securing means (4A, 4B) formed by a U shaped stirrup (40, 41, 42).

10. Fixing system according to claim 8, further characterized in that the first securing means is a U shaped bar placed astride the inside of each cylinder (20, 21) and means for fixing said first securing means to the upright (11) of the frame.

11. Variable and articulated suspension fixing system, particularly for beds or seats having slats, comprising a suspension and articulation piece (2), a first means (4A, 4B) for securing the suspension piece (2) to the frame (1) of the mattress or seat, a second means (51, 52) for securing a slat (3) to the suspension piece (2), said suspension piece (2) comprising two symmetrical resilient structures (20, 21) in the form of cylindrical tubes parallel to said slat and spaced apart by a distance corresponding to the dimension of a portion (30) of said slat bearing on a surface of said suspension piece (2), the two resilient structures (20, 21) being joined together by a single connecting strut (22), characterized in that the connecting strut is connected to the two cylindrical tubes by connecting surfaces that are situated inside the volume defined by vertical planes passing through the axes of symmetry of each cylinder, said connecting strut further characterized as providing the bearing surface for said slat portion wherein each cylindrical tube has a circular section and further characterized in that a wedge (60) is placed between the two cylindrical tubes (20, 21), said wedge (60) having lateral surfaces (61, 63) corresponding to quarters of an ellipse and spaced apart so that the small axis of symmetry of the ellipses coincides with the axes of symmetry of the two structures.

12. Firing system according to claim 11, characterized in that the structure comprises on the diameter opposite the point of contact of the strut (22) with each structure (20, 21) a tongue (23,24) clamped to the frame by a first securing means (4A, 4B) formed by a U shaped stirrup (40, 41, 42).

13. Fixing system according to claim 11, further characterized in that the first securing means is a U shaped bar placed astride the inside of each cylinder (20, 21) and means for fixing said first securing means to the upright (11) of the frame.

14. Variable and articulated suspension fixing system, particularly for beds or seats having slats, comprising a suspension and articulation piece (2), a first means (4A, 4B) for securing the suspension piece (2) to the frame (1) of the mattress or seat, a second means (51, 52) for securing a slat (3) to the suspension piece (2), said suspension piece (2) comprising two symmetrical resilient structures (20, 21) in the form of cylindrical tubes parallel to said slat and spaced apart by a distance corresponding to the dimension of a portion (30) of said slat bearing on a surface of said suspension piece (2), the two resilient structures (20, 21) being joined together by a single connecting strut (22), characterized in that the connecting strut is connected to the two cylindrical tubes by connecting surfaces that are situated inside the volume defined by vertical planes passing through the axes of symmetry of each cylinder, said connecting strut further characterized as providing the bearing surface for said slat portion wherein each cylindrical tube has a circular section and further characterized in that the structure comprises on the diameter opposite the point of contact of the strut (22) with each structure (20, 21), a tongue (23, 24) clamped to the frame by a first securing means (4A, 4B) formed by a U shaped stirrup (40, 41, 42).

15. Fixing system according to claim 14, further characterized in that the second securing means is a rivet (50, 51) with a flat head (50) on the shank (51) of which a locking washer (52) is fitted.

16. Variable and articulated suspension fixing system, particularly for beds or seats having slats, comprising a suspension and articulation piece (2), a first means (4A, 4B) for securing the suspension piece (2) to the frame (1) of the mattress or seat, a second means (51, 52) for securing a slat (3) to the suspension piece (2), said suspension piece (2) comprising two symmetrical resilient structures (20, 21) in the form of cylindrical tubes parallel to said slat and spaced apart by a distance corresponding to the dimension of a portion (30) of said slat bearing on a surface of said suspension piece (2), the two resilient structures (20, 21) being joined together by a single connecting strut (22), characterized in that the connecting strut is connected to the two cylindrical tubes by connecting surfaces that are situated inside the volume defined by vertical planes passing through the axes of symmetry of each cylinder, said connecting strut further characterized as providing the bearing surface for said slat portion wherein each cylindrical tube has a parallelepiped section and further characterized in that the structure comprises on the diameter opposite the point of contact of the strut (22) with each structure (20, 21) a tongue (23, 24) clamped to the frame by a first securing means (4A, 4B) formed by a U shaped stirrup (40, 41, 42).

17. Fixing system according to claim 16, further characterized in that the second securing means is a rivet (50, 51) with a flat head (50) on the shank (51) of which a locking washer (52) is fitted.

18. Variable and articulated suspension fixing system, particularly for beds or seats having slats, comprising a suspension and articulation piece (2), a first means (4A, 4B) for securing the suspension piece (2) to the frame (1) of the mattress or seat, a second means (51, 52) for securing a slat (3) to the suspension piece (2), said suspension piece (2) comprising two symmetrical resilient structures (20, 21) in the form of cylindrical tubes parallel to said slot and spaced apart by a distance corresponding to the dimension of a portion (30) of said slat bearing on a surface of said suspension piece (2), the two resilient structures (20, 21) being joined together by a single connecting strut (22), characterized in that the connecting strut is connected to the two cylindrical tubes by connecting surfaces that are situated inside the volume defined by vertical planes passing through the axes of symmetry of each cylinder, said connecting strut further characterized as providing the bearing surface for said slat portion wherein the first securing means is a U shaped bar placed astride the inside of each cylinder (20, 21) and means for fixing said first securing means to the upright (11) of the frame.

* * * * *